US009988593B2

(12) United States Patent
Wyne et al.

(10) Patent No.: US 9,988,593 B2
(45) Date of Patent: Jun. 5, 2018

(54) RAPID DRYING CLEANING SOLUTION

(71) Applicants: Robert Wyne, Ocean City, MD (US); Abdul H. Ally, Gaithersburg, MD (US)

(72) Inventors: Robert Wyne, Ocean City, MD (US); Abdul H. Ally, Gaithersburg, MD (US)

( * ) Notice: Subject to any disclaimer, the term of this patent is extended or adjusted under 35 U.S.C. 154(b) by 11 days.

(21) Appl. No.: 14/952,030

(22) Filed: Nov. 25, 2015

(65) Prior Publication Data

US 2017/0145349 A1 May 25, 2017

(51) Int. Cl.

| | |
|---|---|
| ***C11D 3/43*** | (2006.01) |
| ***C11D 3/04*** | (2006.01) |
| ***C11D 3/20*** | (2006.01) |
| ***C11D 3/33*** | (2006.01) |
| ***C11D 9/08*** | (2006.01) |
| ***C11D 9/26*** | (2006.01) |
| ***C11D 9/30*** | (2006.01) |
| ***C11D 11/00*** | (2006.01) |

(52) U.S. Cl.

CPC ..... *C11D 3/044* (2013.01); *C11D 3/201* (2013.01); *C11D 3/2017* (2013.01); *C11D 3/33* (2013.01); *C11D 9/08* (2013.01); *C11D 9/26* (2013.01); *C11D 9/30* (2013.01); *C11D 11/0023* (2013.01)

(58) Field of Classification Search

CPC ..... C11D 1/04; C11D 3/2075; C11D 17/049; C11D 3/044; C11D 11/0023; C11D 7/06

USPC ..... 510/505

See application file for complete search history.

(56) References Cited

U.S. PATENT DOCUMENTS

| | | | | |
|---|---|---|---|---|
| 6,555,515 | B1 | 4/2003 | Hees | |
| 6,784,148 | B2 | 8/2004 | Tadrowski | |
| 7,745,383 | B2 | 6/2010 | Dreja | |
| 8,585,829 | B2 | 11/2013 | Li | |
| 8,821,648 | B2 | 9/2014 | Lourenco | |
| 2003/0125226 | A1 | 7/2003 | Lewis | |
| 2012/0283165 | A1* | 11/2012 | Man | A01N 37/16 510/491 |

FOREIGN PATENT DOCUMENTS

CN 105125128 A * 12/2015

* cited by examiner

*Primary Examiner* — Gregory Webb

(74) *Attorney, Agent, or Firm* — Quickpatents, LLC; Kevin Prince

(57) ABSTRACT

A rapid drying cleaning solution comprises a chelating agent, a detergent, base, alcohol, and water. This cleaning solution can optionally contain fragrances and coloring agents, and can clean a variety of surfaces including natural and engineered wood, ceramic, cement, natural stone, man-made composites, porcelain floors, and other surfaces such as steel, stainless steel, other metallic compositions, ceramic, porcelain, wood and engineered wood countertops, followed by rapid drying of the surface being cleaned.

8 Claims, No Drawings

RAPID DRYING CLEANING SOLUTION

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to cleaning solutions, and more particularly to a rapidly drying cleaning solution suitable for use on floors and other surfaces where rapid drying is desired.

DISCUSSION OF RELATED ART

The vast majority of cleaning solutions vary in their applicability from aggressive sodium hypochlorite-based mixtures used in dishwashing detergents and bactericidal floor cleaners, to cleaning solutions which are designed for cleaning fabrics without causing damage to the material being cleaned. However, such cleaning solutions have focused on addressing cleaning action across a wide spectrum of contaminants, but do not address the speed at which the cleaner can be removed at the time it is applied to the surface to be cleaned, especially since the presence of residual cleaning solution on flooring surfaces following cleaning represents a significant fall hazard to the public in proximity to the area being cleaned. It is therefore a feature of the present invention that addresses this drying issue and presents a solution that not only combines safe, effective cleaning but also significantly enhances the drying process following application to the surface being cleaned.

Therefore, there is a need for a cleaning solution that dries relatively quickly once applied to a surface to be cleaned. The needed invention would also provide safe, effective cleaning to the surface that does not leave behind a slippery residue after evaporation. The present invention accomplishes these objectives.

SUMMARY OF THE INVENTION

The current invention provides an environmentally safe, rapid drying cleaning solution, comprised of a mixture of materials in which one of the active ingredients is derived from naturally occurring sources while the other ingredients are commonly used, and are considered non-toxic in the relative proportions used in the development of this cleaning solution. Specifically, the invention comprises a coconut-based detergent and surfactant, an alcohol to speed drying, an alkali metal base which may be selected from sodium, potassium, or magnesium, a chelating agent to further impart bacteriostatic activity, and water.

The compositions of this rapid drying cleaning solution are effective in speeding the evaporation and drying time of the cleaning solution following its application to surfaces being cleaned, while also effectively removing contaminating materials including food residue, oil, coffee or juice. The rapid drying cleaning solution compositions, in addition to being environmentally safe are also inexpensive compared with other cleaners. The alcohol used as the drying agent is a short chain primary moiety, such as a C.sub.1 to C.sub.4 alcohol, linear primary alcohol or branched secondary alcohol. The detergent may be n-dodecanoic acid (lauric acid) or similar fatty acid. Fatty acid detergents are comprised of a carbon chain of 4 to 30 carbons in length linked to a carboxylic acid moiety. Examples of fatty acids also include but are not limited to soy fatty acids, linoleic, palmitic, and capric acids. Such detergents are present at a concentration between 0.05% and 10% in the rapid drying cleaner, while the percent alcohol may be between 0.5% and 15%. The percent alkali metal base in the rapid drying cleaner may be between 0.001% and 5%. The percent chelator in the rapid drying cleaner may be between 0.001% and 2%. Chelators are important in the formulation of this invention because they confer the ability to sequester metal ions and destabilize certain compounds containing metal ions.

The present invention is a cleaning solution that dries relatively quickly once applied to a surface to be cleaned. The present solution also provides safe, effective cleaning to the surface, and does not leave behind a slippery residue after evaporation. Other features and advantages of the present invention will become apparent from the following more detailed description, which illustrates, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

The present disclosure describes compositions of matter and methods for solubilizing and removing contaminating substances including food residue, oil, coffee or juice followed by rapid evaporation of residual liquid from the surface of the substrate being cleaned, the latter residual liquid presenting a fall hazard if the substrate is a floor. In particular, the composition includes water, alcohol, an alkali base, a chelating agent, and a fatty acid-based detergent. The composition may have a pH range between 7.0 and 8.8. The composition may be used for the combined action of cleaning and drying surfaces.

The composition may contain one or more types of alcohol. For instance, saturated alcohols and unsaturated alcohols may be utilized in the present compositions. Branched chain alcohols, which may optionally be incorporated into the present compositions, include any C.sub.1 to C.sub.4 alcohol, linear or branched.

The composition may be an aqueous solution of at least one base. The solution may include any ion or species which may be selected to maintain the desired alkalinity. The base of the cleaning composition may be selected from alkali bases (sodium, potassium, magnesium).

The composition may be an aqueous solution of at least one detergent, at a concentration of between about 0.01% to 10% weight/volume (w/v). The stock rapid drying cleaner composition includes an alcohol which may comprise up to about 0.5% to 15% w/v of the composition. For example, one composition may be comprised of 5% (w/v) detergent, between 0.01% and 5% alkali metal base, between about 0.5% to 15% w/v alcohol, such as a short chain alcohol, and between 0.001% and 2% chelator such as disodium EDTA or tetrasodium EDTA in an aqueous solution.

The composition may be used in a wide variety of situations in academia, industry, government, medical and consumer settings. Those with ordinary skill in the art will understand that other variations and embodiments of the invention are possible, which utilize the concepts described above.

Currently, methodology for the removal of contaminants from a multitude of surfaces and applications include formulations which require a first cleaning application followed by a rinsing application using mainly aqueous solutions, preferably water. The consequence of incorporating this rinse step causes prolonged wet surfaces which, if the surface being cleaned is a floor, can result in significant "slip and fall" injuries. In the case of cleaning a table top surface in a restaurant, it is desirable that the table become dry as quickly as possible so that a new party seated at the table does not have to wait long for the table top to dry. In addition, wet surfaces attract particulate matter and microorganisms carried by air drafts, exacerbated by long dry times when water is used as a rinse aid due to its polar nature.

Furthermore, although there are many types of cleaning solutions available on the market, no known solutions are available which specifically dissolve contaminants and at the same time permit rapid drying while being relatively non-toxic, non-caustic as well as being environmentally friendly both in manufacture and use.

Once the composition is combined with contaminants on the floor surface, the composition is relatively efficient in "lifting" and solubilizing the contaminants. The combination of the cleaning solution and the suspended contaminants are substantially removed from the floor surface with a mop or other applicator. The applicator is then wrung-out or compressed and then reapplied to the floor surface to remove more of the cleaning solution/contaminants mixture until most has been removed from the floor surface. The liquid portion of any cleaning solution left behind on the floor surface is relatively volatile and accelerates the drying process once the excess cleaner and dirt/contaminants have been removed.

During dry time testing it was found that the composition of the present invention dried nearly three times faster than basic soap and water agents (59 seconds vs. 2 minutes and 59 seconds). On greasy surfaces, the present composition cleaned the grease without leaving residue on the surface and dried in 118 seconds, while the best that a conventional cleaning solution could do was 6 minutes 31 seconds while still leaving a greasy residue behind on the surface.

While a particular form of the invention has been described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventors contemplate the various aspects of the invention in any number of claim forms. Accordingly, the inventors reserve the right to add additional claims after filing the application to pursue such additional claim forms for other aspects of the invention.

What is claimed is:

1. A rapid drying cleaning solution comprising: a chelating agent of proportion between 0.001% and 0.4% (w/v), a detergent derived from a fatty acid, an alkali base of proportion between 0.001% and 0.04% (w/v), an alcohol of proportion between 0.5% and 19% (v/v), and water.

2. A rapid drying cleaning solution comprising: a chelating agent of proportion between 0.001% and 0.4% (w/v), a detergent derived from processed coconut, an alkali base of proportion between 0.001% and 0.04% (w/v), an alcohol of proportion between 0.5% and 19% (v/v), and water.

3. The rapid drying cleaning solution according to claim 1 wherein the chelating agent includes EDTA, the detergent is n-dodecanoic acid, the alkali base is sodium hydroxide, and the alcohol is isopropanol.

4. The rapid drying cleaning solution according to claim 1 wherein the detergent includes lauric acid.

5. The rapid drying cleaning solution according to claim 1 wherein the alcohol is selected from a group consisting of: ethanol, propanol, isopropanol, and mixtures thereof.

6. The rapid drying cleaning solution according to claim 1 wherein the alkali base is selected from the group consisting of ions of: sodium, potassium, magnesium, and mixtures thereof.

7. The rapid drying cleaning solution according to claim 1, wherein the proportion of the detergent is between 0.05% and 10% (w/v).

8. A method for removing surface contaminants from a surface, comprising the steps:

a) providing a rapid drying cleaning solution comprising a chelating agent, a detergent derived from a fatty acid, an alkali metal base, an alcohol, and water;

b) contacting the rapid drying cleaning solution with the surface by either direct or indirect application of the rapid drying cleaning solution;

c) contacting the surface with an applicator in a wiping or scrubbing motion to distribute the solution along the surface while subsequently removing contaminants from the surface through absorption of both the contaminants and the cleaning solution into the applicator;

d) removing the cleaning solution/contaminant mixture from the applicator by mechanical wringing or compression; and e) repeating from step c) until most of the cleaning solution/contaminant mixture has been removed from the surface, whereupon any remaining surface moisture dries rapidly.

* * * * *